US005231406A

United States Patent [19]

Sreenivas

[11] Patent Number: 5,231,406

[45] Date of Patent: Jul. 27, 1993

[54] BROADBAND CIRCULAR POLARIZATION SATELLITE ANTENNA

[75] Inventor: Ajay I. Sreenivas, Longmont, Colo.

[73] Assignee: Ball Corporation, Muncie, Ind.

[21] Appl. No.: 681,100

[22] Filed: Apr. 5, 1991

[51] Int. Cl.[5] ..... H01Q 1/38

[52] U.S. Cl. ..... 343/700 MS; 343/829

[58] Field of Search ..... 343/700 MS, 829, 846, 343/850, 853, 830

[56] References Cited

U.S. PATENT DOCUMENTS

| | | | |
|---|---|---|---|
| 3,921,177 | 11/1975 | Munson | 343/846 |
| 4,079,268 | 3/1978 | Fletcher et al. | 307/151 |
| 4,366,484 | 12/1982 | Weiss et al. | 343/700 MS |
| 4,477,813 | 10/1984 | Weiss | 343/700 |
| 4,543,579 | 9/1985 | Teshirogi | 343/365 |
| 4,614,947 | 9/1986 | Rammos | 343/778 |
| 4,623,893 | 11/1986 | Sabban | 343/700 MS |
| 4,719,470 | 1/1988 | Munson | 343/700 MS |
| 4,761,654 | 8/1988 | Zaghloul | 343/700 MS |
| 4,792,810 | 12/1988 | Fukuzawa et al. | 343/778 |
| 4,835,538 | 5/1989 | McKenna et al. | 343/700 MS |
| 4,866,451 | 9/1989 | Chen | 343/700 |
| 4,914,445 | 4/1990 | Shoemaker | 343/700 |
| 4,943,809 | 7/1990 | Zaghloul | 343/700 MS |
| 4,980,694 | 12/1990 | Hines | 343/700 MS |
| 4,990,926 | 2/1991 | Otsuka et al. | 343/700 |
| 5,041,838 | 8/1991 | Liimatainen et al. | 343/700 MS |
| 5,043,738 | 8/1991 | Shapiro et al. | 343/700 MS |

FOREIGN PATENT DOCUMENTS

| | | | |
|---|---|---|---|
| 0432647 | 6/1991 | European Pat. Off. . | |
| 0178001 | 10/1984 | Japan | 343/700 MS |

OTHER PUBLICATIONS

Teshirogi et al., "Wideband Circularly Polarized Array Antenna with Sequential Rotations and Phase Shift of Elements", Proceedings of ISAP '85, pp. 117–120.

Lee et al., "Microstrip Subarray with Coplanar and Stacked Parasitic Elements", Electronic Letters, May 10, 1990, vol. 26, No. 10, pp. 668–669.

Huang, "A Technique for an Array to Generate Circular Polarization with Linearly Polarized Elements", (IEEE Transactions on Antennas and Propagation, vol. AP-34, No. 9, Sep. 1986, pp. 1113–1124).

Araki et al., "Numerical Analysis of Circular Disk Microstrip Antenna with Parasitic Elements", (IEEE Transactions on Antennas and Propagation, vol. AP-34, No. 12, Dec. 1986, pp. 1390–1394).

Hall et al., "Design Principles of Sequentially Fed, Wide Bandwidth, Circularly Polarised Microstrip Antennas", (IEE Proceedings, vol. 136, Pt. II., No. 5, Oct. 1989, pp. 381–389).

Hall, "Application of Sequential Feeding to Wide Bandwidth, Circularly Polarised Microstrip Patch Arrays", (IEE Proceedings, vol. 136, Pt. 11, No. 5, Oct. 1989, pp. 390–398).

*Primary Examiner*—Rolf Hille
*Assistant Examiner*—Hoanganh Le
*Attorney, Agent, or Firm*—Gilbert E. Alberding

[57] ABSTRACT

A broadband, circular polarization antenna is disclosed for use on a satellite. In one embodiment, signals are fed to, or received by, an array of electromagnetically coupled patch pairs arranged in sequential rotation by an interconnect network which is coplanar with the coupling patches of the patch pairs. The interconnect network includes phase transmission line means, the lengths of which are preselected to provide the desired phase shifting among the coupling patches. The complexity of the array and the space required are thus reduced. In the described embodiment, two such arrays are employed, each having four patch pairs. The two arrays are arranged in sequential rotation to provide normalization of the circularly polarized transmitted or received beam.

28 Claims, 4 Drawing Sheets

BROADBAND CIRCULAR POLARIZATION SATELLITE ANTENNA

TECHNICAL FIELD OF THE INVENTION

This invention relates in general to a broadband circular polarization satellite antenna and, in particular, to an antenna arrangement of microstrip patches having a unique sequential rotation feed network.

BACKGROUND OF THE INVENTION

Microstrip patch antennas are popular because they are generally small and light, relatively easy to fabricate, and with the proper feeding/receiving network, can transmit/receive beams of various polarizations. The small size and light weight of microstrip patch antennas are particularly advantageous for satellite applications in which such parameters directly affect project costs (such as the cost to launch a satellite into orbit).

Patch antennas which transmit and/or receive signals which are circularly polarized, as opposed to linearly polarized, are particularly useful in satellite communication systems. Linear polarization requires that an earth station tightly align its frame of reference with that of a satellite in order to achieve acceptable communications. Furthermore, as linearly polarized radiation propagates through the earth's atmosphere, its orientation tends to change thus making the earth-satellite alignment difficult to maintain. Circularly polarized radiation is less affected by such considerations. However, to achieve satisfactory communications, the degree of circular polarization (as measured by axial ratio) should be relatively high over a relatively broad bandwidth.

The bandwidth of a directly fed microstrip patch antenna is generally narrow (compared to, for example, a standard horn antenna), due at least in part to the thinness of the substrate on which the patch is fabricated. To broaden bandwidth, electromagnetically coupled patches (EMCP) can be employed which include, for example, a coupling patch on a first substrate and an antenna patch on a second substrate, the coupled patches being substantially parallel and separated by a particular distance. The greater the separation distance, the greater the increase in bandwidth. Bandwidth is further increased by selecting a material to fill the separation distance which has a low dielectric constant (i.e., ideally 1=the dielectric constant of air). Such material should preferably provide structural rigidity to insure uniform EMCP spacing, and should be lightweight.

One method to enhance the purity of circular polarization of patch antennas (i.e., to reduce the axial ratio) is to connect a plurality of complimentary patches to a feeding network in sequential rotation whereby there is a uniform angular spacing of the feeding points between the patches. In this fashion, the orientation of the radiation from each patch is rotated relative to the orientation of the radiation from complementary patches. Furthermore, the feeding network should preferably provide a uniform phase difference between the signals sent to or received from the patches. For example, in a four patch arrangement, the signal fed to the first patch has a particular phase relationship with respect to the feedline; the signal fed to the second patch lags by 90° the signal fed to the first patch; the signal fed to the third patch lags by 180° the signal fed to the first patch and lags by 90° the signal fed to the second patch; and the signal to the fourth patch lags by 270° the signal fed to the first patch, lags by 180° the signal fed to the second patch, and lags by 90° the signal fed to the third patch. In addition, the location of the feeding point on each patch is correspondingly rotated 90° so that the feed point of the second patch is rotated 90° with respect to the feed point of the first patch; the feed point of the third patch is rotated 90° with respect to the feed point of the second patch and 180° from the feed point of the first patch; and, the feed point of the fourth patch is rotated 90° with respect to the feed point of the third patch, 180° from the feed point of the second patch and 270° from the feed point of the first patch.

A larger number of feed patches can be used as long as the signal phases and feed locations are uniformly distributed around 360°. Ideally, the combined radiation from all of the patches would have perfectly circular polarization (i.e., OdB axial ratio). In actual practice, of course, such perfect circular polarization has not been achieved.

Heretofore, hybrids have often been employed to phase shift the signal fed to (or from) the patches in a sequential rotation network. The use of such hybrids in a feeding network may consume so much space, however, that in many applications with space constraints the feeding network may have to be situated on a separate substrate and coupled directly or electromagnetically to the microstrip patch (which can be an antenna patch or, in the case of EMCP, a coupling patch). As can be appreciated, this increases the complexity and cost of the antenna and tends to reduce its efficiency. If fewer patches are used, or if the same number of patches are used but they are spread out over a larger area, space may be available for the hybrids but the radiation pattern may have excessive grating lobes resulting in reduced efficiency and degraded coverage characteristics. If more patches are used, or if the same number of patches are used but are placed closer together, coupling between patches may seriously degrade antenna performance.

It is desirable, therefore, to provide an antenna having high purity circular polarization (i.e., a low axial ratio), substantially uniform coverage, broad bandwidth and high efficiency, and which is easy and inexpensive to fabricate. It is further desirable for such an antenna to be small, lightweight and to be fabricated from space qualified materials so as to be well-suited for use in a satellite. It is also desirable that the material used between substrates in an EMCP pair have a low dielectric constant, be lightweight and rigid, and to provide for substantially uniform spacing between the substrates.

SUMMARY OF THE INVENTION

In accordance with the present invention, a broadband antenna is provided having high purity circular polarization, substantially uniform coverage and high efficiency while being easy to fabricate. In addition, the antenna of the present invention is lightweight, small and can be fabricated with space qualified materials.

In particular, the antenna of the present invention employs an array of microstrip patches which are coupled in sequential rotation by phase transmission line means to a signal transmission means. The phase transmission line means comprise microstrip transmission lines whose lengths are preselected to provide appropriate phase shifting for the sequentially rotated patches. Therefore, space can be saved and the phase transmission line means can be coplanar with the patches. Preferably, portions of two or more phase transmission line means are defined by a common length of transmission line, wherein further space is saved.

In another aspect of the present invention, two or more subarrays are provided, wherein the patches of each subarray are coupled in sequential rotation. Preferably, the subarrays are also coupled in sequential rotation; i.e., the signal fed to or from each subarray is shifted relative to the others to provide a substantially uniform phase shift among the subarrays around 360° and the angular orientation of each subarray is shifted relative to the others to provide a substantially uniform rotation among the subarrays around 360°. Such an arrangement provides for normalization of the circularly polarized radiated signal (or, because the antenna is bi-directional, the received signal) providing a low axial ration over a broad bandwidth.

In one embodiment, two subarrays are provided, each having four electromagnetically coupled patch (EMCP) pairs of coupling and antenna patch elements. The signal fed to the second subarray is phase shifted 180° from the signal fed to the first subarray and the second subarray is rotated 180° with respect to the first subarray. Sequential rotation among the four patch pairs in each subarray provides a 90° phase shift between adjacent patch pairs. The feed locations of the coupling patches are similarly shifted 90° within each subarray. When coupled to external circuitry to provide phase shifting of the signals fed to (or from ) the antenna system, the antenna can scan a broad volume. Such an arrangement provides satisfactory performance for use in a satellite with substantially uniform coverage while reducing the space required for the antenna.

A lightweight, rigid honeycomb material is preferably employed between the substrate on which the coupling patches are disposed and the substrate on which the antenna patches are disposed and is also preferably employed between the substrate on which the coupling patches are disposed and a ground reference located below the coupling patch substrate. The honeycomb material has a low dielectric constant and is sufficiently rigid to yield substantially uniform spacing between the subarray layers.

Consequently, the antenna of the present invention provides the technical advantage of having a low axial ratio and a broad bandwidth, and being highly efficient with substantially uniform coverage and easy to fabricate. It provides the further technical advantages of being lightweight, small and capable of being fabricated with space qualified materials.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The present invention will be further described with reference to FIGS. 1-4. When used herein, such terms as "horizontal", "vertical", "top", "bottom", "upper", "lower", "left" and "right" are for descriptive purposes only and are not intended to limit the invention to any particular physical orientation. Furthermore, the antenna of the present invention is reciprocal in that it can receive signals, as well as transmit them. Consequently, references herein to "transmitting," "radiating" and "generating" beams apply equally to receiving beams.

Figure 1:
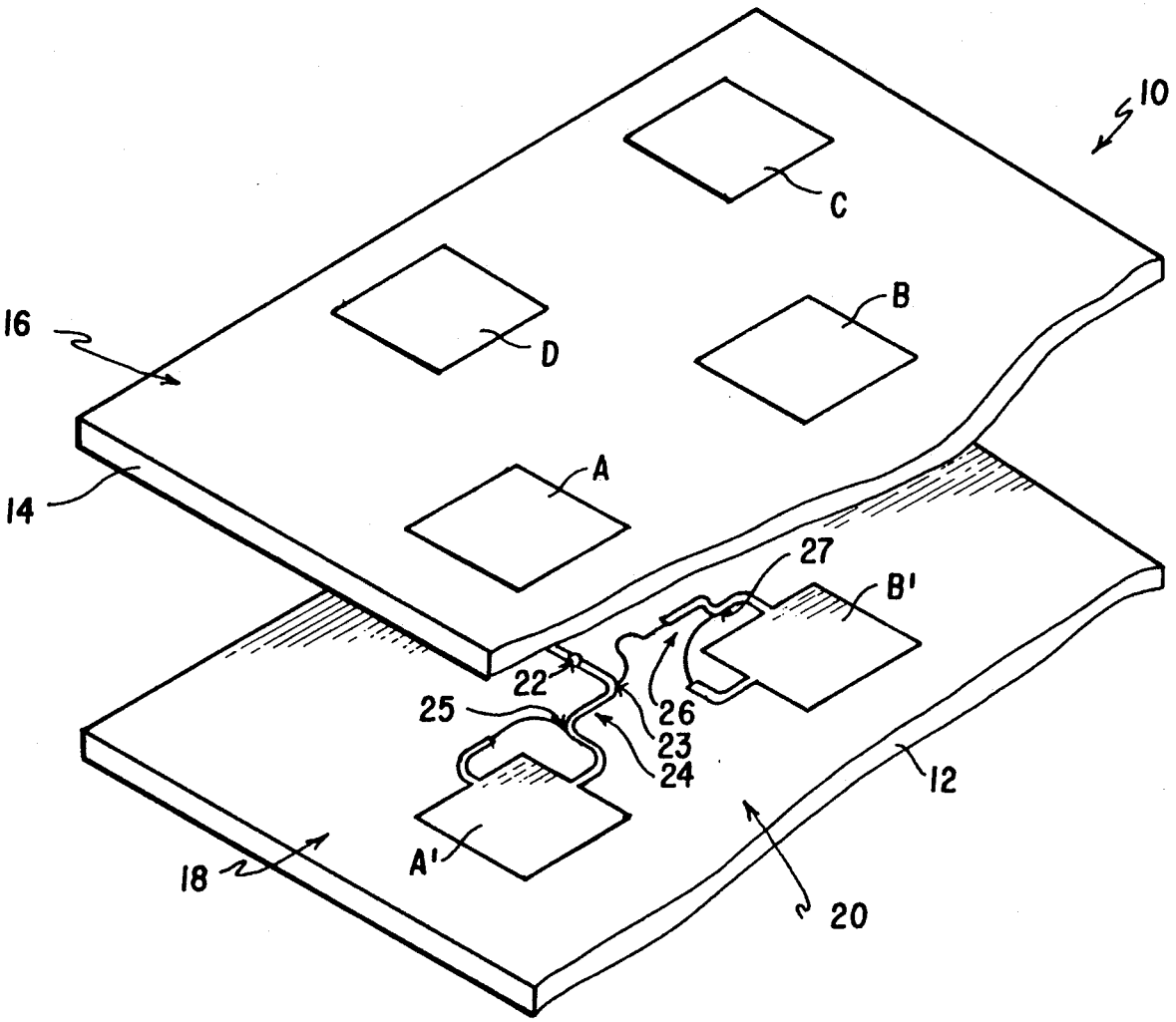
FIG. 1 illustrates an exploded, partially cutaway view of selected components of the present invention.

FIG. 1 illustrates an exploded, partially cutaway view of selected components of an antenna comprising the present invention, generally indicated as 10. The antenna 10 includes a first substrate 12 and a second substrate 14 which are positioned in substantially parallel relation. An subarray of microstrip patch antenna elements 16 is disposed on the top surface of second substrate 14. Individual antenna elements A, B, C and D are shown in FIG. 1. An array of corresponding microstrip patch coupling elements 18 is disposed on the top surface of first substrate 12. Individual coupling elements A' and B' are shown in FIG. 1 and form electromagnetically coupled patch pairs (EMCP pairs) AA' and BB' with antenna elements A and B of antenna subarray 16. Coupling elements C' and D' (not shown) form EMCP pairs CC' and DD' with corresponding antenna elements C and D. Coupling elements 18 and antenna elements 16 could be disposed on either the top or bottom surfaces of first and second substrates 12 and 14 so long as spacing therebetween is maintained to achieve the desired electromagnetic coupling and bandwidth.

Disposed on the same substrate surface as coupling elements 18 (i.e., top surface of substrate 12 in FIG. 1) are phase transmission line means, referred to collectively as an interconnect network 20, which couple coupling elements A'-D' to a signal transmission means (not shown) at a feed point 22. Interconnect network 20 divides a signal from the signal transmission means and distributes it among the coupling elements when antenna 10 is used for transmitting. It combines reception signals from the coupling elements and directs the resulting signal to the signal transmission means when antenna 10 is used for receiving. By way of example, phase transmission line means 24 couples feed point 22 and coupling element A', via junctions 23 and 25, and phase transmission line means 26 couples feed point 22 and coupling element B', via junctions 23 and 27.

As will be appreciated, a microstrip patch element naturally radiates energy with linear polarization. It can be made to radiate circularly (or more accurately elliptically) polarized energy by exciting two orthogonal modes on the patch in phase quadrature (that is, with a 90° phase difference between the two modes). For example, the patches in coupling sub array 18 and antenna subarray 16 are square in shape. As such, to obtain circular polarization, adjacent sides (being 90° apart) of each coupling element in coupling array 18 can be excited with signals which have a 90° phase difference. In interconnect network 20 shown in FIG. 1, such phase difference is accomplished by proper selection of the lengths of the phase transmission line means coupled to adjacent sides of the coupling elements. For example, as to coupling element A', the length of phase transmission line means 24 from junction 25 to two adjacent sides of coupling element A' is offset to provide a 90° phase difference. Similarly, as to coupling element B', the length of phase transmission line means 26 from junction 27 to two adjacent sides of coupling element B' is offset to yield a 90° phase difference.

To achieve high quality circular polarization (i.e., polarization having a low axial ratio), a plurality of patches in an array can be excited in sequential rotation to reduce elliptical components. That is, if there are N elements in the array, the feed location of each patch is rotated by 360°/N from that of the previous patch in the sequence so that the feed locations within the array are substantially uniformly spaced around 360°. The signal fed to each element is similarly phase shifted by 360°/N from the previous patch in the sequence, relative to the signal at the first patch. The phase shift and rotation of the feed location of any coupling element in a coupling subarray, relative to the first element, is: (P-1) * (360°/N), where P (P≦N) is the element number in an array. Thus, radiation of one sense of circular polarization (such as right hand circular polarization) adds constructively while radiation of the opposite sense (such as left hand circular polarization) is substantially canceled. In the antenna 10 illustrated in FIG. 1, there are four EMCP pairs. The phase shift between adjacent pairs is therefore 360°/4 90°. Similarly, the feed location on each coupling element in coupling subarray 18 is rotated 90° from that of the previous coupling element.

Unlike typical prior antenna arrays which utilize sequential rotation, sequential rotation of the present invention is provided by phase transmission line means without hybrids. In further contrast, EMCP pairs are employed with the phase transmission line means being disposed on a common substrate surface with the coupling patches. For example, the 90° phase shift between individual coupling element A' and individual coupling element B' in FIG. 1 is provided by selecting the relative lengths of phase transmission line means 24 and 26, and in particular, by establishing a greater length from junction 23 to 27 than from junction 23 to 25. As such, a signal received by coupling element B' is delayed by 90° relative to signal receipt by coupling element A' due to the greater length through which it must travel to reach coupling element B'. It can be also seen in FIG. 1 that the feed locations on coupling element B' are rotated 90° counterclockwise from the feed locations of coupling element A'. Similar phase shifts and rotations occur for coupling elements C' and D'.

The signal radiating from antenna 10 is essentially a combination of the radiation radiated from the four individual EMCP pairs. Due to the sequential rotation, the orientation of the somewhat elliptical radiation beams are rotated relative to each other such that the desired and undesired senses of circularly polarized radiation from each EMCP pair tend to be strengthened and weakened, respectively. The combined result is a beam having a very low axial ratio in one circular sense and having substantially no radiation in the opposite sense.

Figure 2:
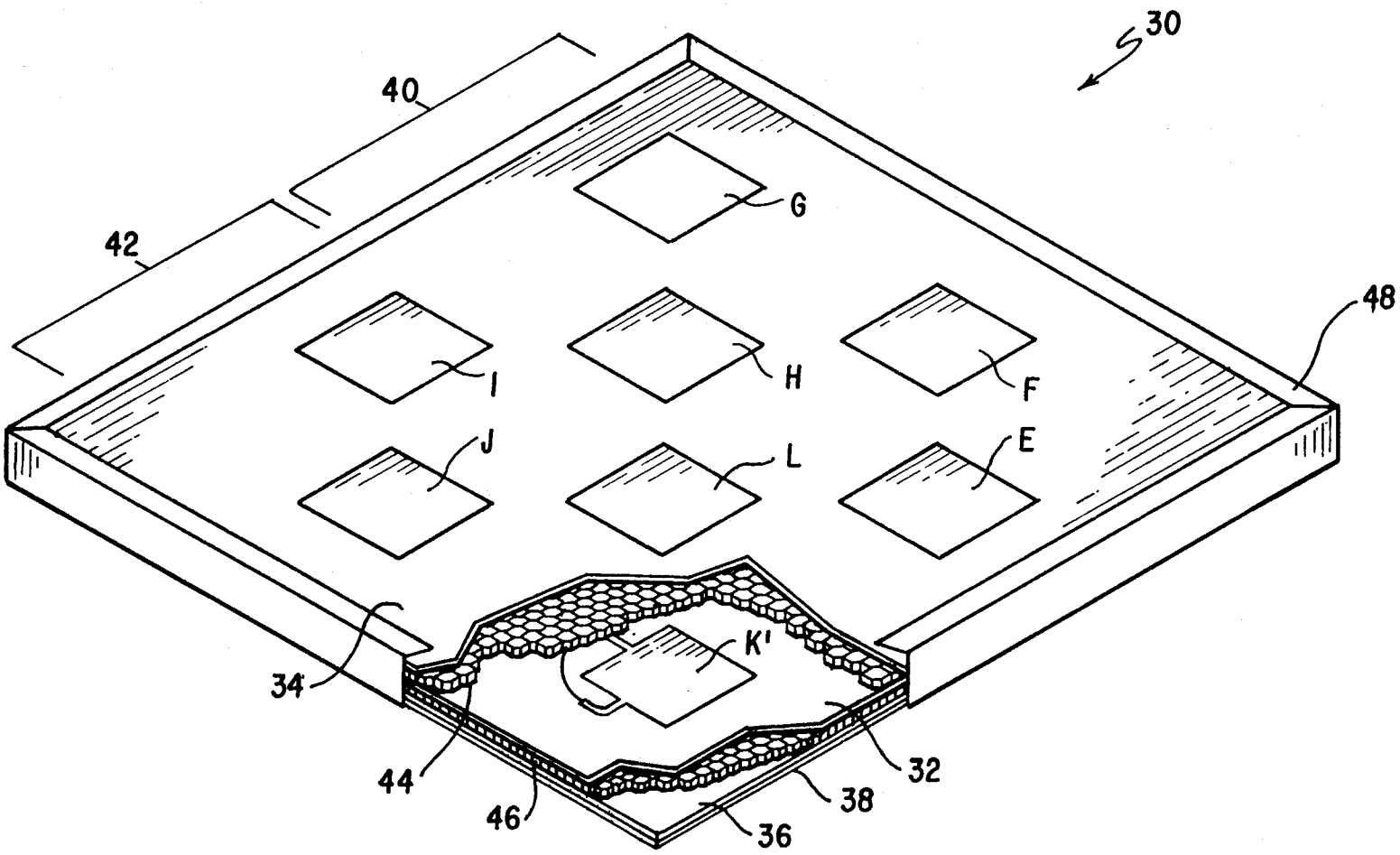
FIG. 2 illustrates a cutaway perspective view of an embodiment of the present invention.
Figure 3:
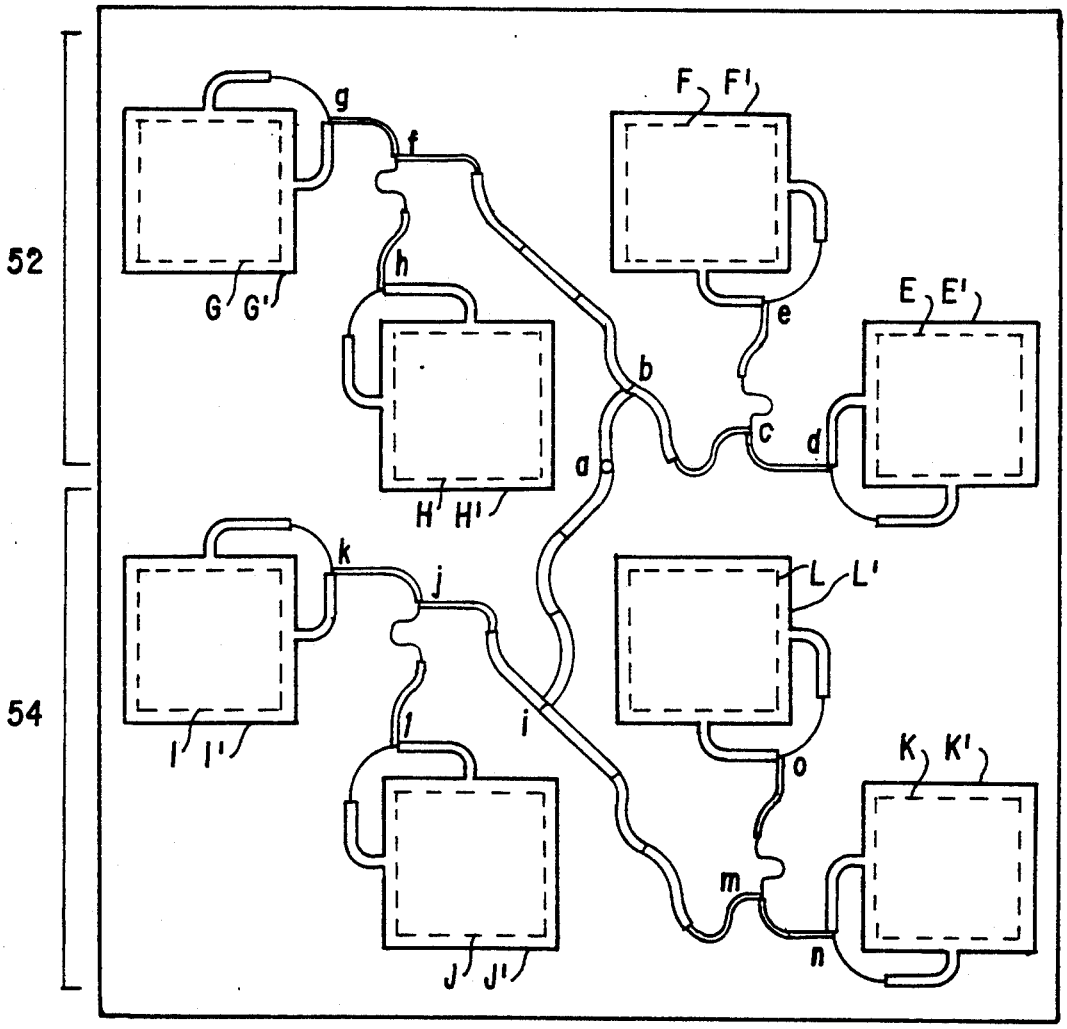
FIG. 3 illustrates the coupling elements (with superimposed, corresponding antenna elements) and phase transmission line means of the embodiment illustrated in FIG. 2.

An embodiment of the antenna of the present invention is illustrated in FIGS. 2 and 3 and generally indicated as 30. A first substrate 32 and a second substrate 34 are positioned substantially parallel to each other and spaced a substantially uniform distance apart. In the embodiment shown, a third substrate 36 is positioned below and substantially parallel to first substrate 32. A ground plane 38 is disposed on the bottom surface of third substrate 36. Disposed on the top surface of second substrate 34 is a first subarray 40 of microstrip patch antenna elements and a second subarray 42 of microstrip patch antenna elements. As shown in FIG. 2, each subarray 40 and 42 has four microstrip patch antenna elements: first subarray 40 has antenna elements E, F, G and H; and second subarray 42 has antenna elements I, J, K and L (antenna element L is not shown in FIG. 2 due to the cutaway nature of the figure). Similarly, as shown in FIG. 3, two subarrays 52 and 54 of corresponding dual-fed coupling elements (E'-H'and I'-L') and corresponding interconnect networks are disposed on the top surface of first substrate 32. A first interconnect network of phase transmission line means (a-b-c-d to E', a-b-c-e to F', a-b-f-g to G', a-b-f-h to H') and a second interconnect network of phase transmission line means (a-i-j-k to I', a-i-j-l to a-i-m-n to K', a-i-m-o to L') connect the coupling elements in the two coupling subarrays to a feed signal transmission means (not shown) at feed point a. Such feed signal transmission means could be, for example, a coaxial cable.

A relatively rigid, lightweight and low dielectric constant spacing material is preferably positioned between first and second substrates 32 and 34 and between first an third substrates 32 and 36. As shown in FIG. 2, honeycomb layers 44 and 46 fabricated from a phenolic resin can be advantageously employed. The low dielectric constant of such a material, about 1 to about 1.5, yields low energy losses and a relatively broad bandwidth. The entire assembly of antenna 30 can be held together by an edge closure 48 around the perimeter of antenna 30.

Analogous to the prior discussion pertaining to FIG. 1, first and second antenna subarrays 40 and 42 and first and second coupling subarrays 52 and 54 of the embodiment shown in FIGS. 2 and 3 could be disposed on either the top or bottom surfaces of second and first substrates 34 and 32, provided that sufficient spacing is maintained therebetween to achieve the desired coupling and bandwidth. For example, the embodiment of FIGS. 2 and 3 could be modified such that first and second antenna subarrays 40 and 42 are disposed on the bottom surface of second substrate 34 and electromagnetically couple with first and second coupling subarrays 52 and 54 through honeycomb spacing material 44, wherein second substrate 34 would be selected to permit passage of the desired radiation therethrough and contemporaneously serve as a protective radome.

The phase transmission line means (a-b-c-d to E', a-b-c-e to F', a-b-f-g to G', a-b-f-h to H') of the first interconnect network and the phase transmission line means 15 (a-i-j-k to I', a-i-j-l to J', a-i-m-n to K', a-i-m-o to L') of the second interconnect network are preferably microstrip transmission lines disposed on same substrate surface as first and second coupling subarrays 52 and 54 (i.e., the top surface of first substrate 32 in FIGS. 2 and 5). Such transmission means could be so provided contemporaneous with coupling patches E'-L' by employing, for example, thin-film photo-etching or thick-film printing techniques. For impedance and power matching between the signal transmission means and the coupling elements, the transmission lines forming the phase transmission line means can be of differing widths, as representatively shown in FIG. 3.

Phase shifting to produce an appropriate sequential rotation relationship among the coupling elements E'-L' of antenna 30 is accomplished with phase transmission line means thereby saving space (e.g. space savings on first substrate 32 in FIGS. 2 and 3). The length of each phase transmission line means is preselected such that a signal is subjected to a predetermined time delay corresponding to a predetermined phase delay (or phase shift). That is, at a particular operating frequency, a phase transmission line means of a first length will cause a 90° phase shift. At the same frequency, a phase transmission line means of a greater second length will cause a 180° phase shift, and so on.

More particularly, four coupling elements in each of subarray 52 and 54 are fed in sequential rotation with a 90° phase shift between adjacent elements. The phase shifting is accomplished with phase transmission line means only and uses no hybrids. In first subarray 52, coupling element E' is coupled to feed point a by a first phase transmission line means a-b-c-d to E'. Coupling element F' is coupled to feed point a by a second phase transmission line means a-b-c-e to F'. Coupling element G' is coupled to feed point a by a third phase transmission line means a-b-f-g to G'. Coupling element H' is coupled to feed point a by a fourth phase transmission line means a-b-f-h to H'.

In second subarray 54, coupling element I' is coupled to feed point a by a fifth phase transmission line means a-i-j-k to I'. Coupling element J' is coupled to feed point a by a sixth phase transmission line means a-i-j-1 to J' Coupling element K' is coupled to feed point a by a seventh phase transmission line means a-i-m-n to K'. Coupling element L' is coupled to feed point a by a eighth phase transmission line means a-i-m-o to L'.

The lengths of first, second, third and fourth phase transmission line means a-b-c-d to E', a-b-c-e to F', a-b-f-g to G' and a-b-f-h to H' are selected wherein, at a predetermined operating frequency: a signal at coupling element E' is in a predetermined phase relationship with respect to the signal at feed point a; the signal at coupling element F' lags that at coupling element E' by 90°; the signal at coupling element G' lags that at coupling element E' by 180 ; and, the signal at coupling element H' that at coupling element E' by 270°. Similarly, the lengths of fifth, sixth, seventh and eighth phase transmission line means a-i-j-k to I', a-i-j-1 to J', a-i-m-n to K' and a-i-m-o to L' are selected wherein, at the predetermined operating frequency: the signal at coupling element I' is in a predetermined phase relationship with respect to the signal at feed point a; the signal at coupling element J' lags that at coupling element I' by 90°; the signal at coupling element K' lags that at coupling element I' by 180°; and, the signal at coupling element L' lags that at coupling element I by 270°.

In the embodiment illustrated in FIG. 3, portions of two or more phase transmission line means are advantageously defined by a common length of line, thereby saving still more space on first substrate 32, reducing the complexity of interconnect networks, and reducing adverse coupling effects between phase transmission line means and coupling elements. Specifically, in first coupling subarray 52, a transmission line a-b is shared by first, second, third and fourth phase transmission line means a-b-c-d to E', a-b-c-e to F', a-b-f-g to G' and a-b-f-h to H'; a transmission line a-b-c is shared by first and second phase transmission line means a-b-c-d to E' and a-b-c-e to F'; and, a transmission line a-b-f is shared by third and fourth phase transmission line means a-b-f-g to G' and a-b-f-h to H'. In second coupling subarray 54, a transmission line a-i is shared by fifth, sixth, seventh and eighth phase transmission line means a-i-j-k to I', a-i-j-1 to J', a-i-m-n to K' and a-i-m-o to L'; a transmission line a-i-j is shared by fifth and sixth phase transmission line means a-i-j-k to I' and a-i-j-1 to J'; and, a transmission line a-i-m is shared by seventh and eighth phase transmission line means a-i-m-n to K' and a-i-m-o to L'.

To further enhance circularity, first coupling subarray 52 and second coupling subarray 54 of antenna 30 are themselves preferably disposed in a sequential rotation relationship: i.e., second coupling subarray 54 is rotated

180° from first coupling subarray 52. To accommodate the 180° physical rotation, the lengths of a ninth phase transmission line means a-b and a tenth phase transmission line means a-i are selected to enable second coupling subarray 54 to be fed with a signal which lags the signal fed to first coupling subarray 52 by 180°.

As previously noted, the coupling elements EMCP pairs EE'-LL' of antenna 30 are preferably fed in phase quadrature to achieve circular polarization. Since the coupling elements in the embodiment shown in FIGS. 2 and 3 are square, each coupling element is connected at adjacent sides to its associated phase transmission line means by two line components whose lengths are selected such that a 90° phase shift is provided between the two sides to provide circular polarization. For example, a first transmission line length connects the lower side of coupling element F' to junction e and a second transmission line length connects the right side of coupling element F' to junction e, the longer length of the second transmission line length effecting a 90° phase lag in the signal at the right side of coupling element F' relative to the signal at the lower side. The arrangement illustrated in FIG. 3 provides right hand circular polarized radiation patterns.

In operation, right hand circular polarized radiation from EMCP pair EE' and right hand circular polarized radiation from the EMCP pair FF' are in phase and add constructively, while left hand circular polarized radiation from the two pairs are 180° out of phase and substantially cancel. Similar additions and cancellations occur between EMCP pairs GG' and HH', between II' and JJ', and between KK' and LL'.

It can be appreciated that other patch geometries (such as circular, elliptical and rectangular patches) can be used and that other feed arrangements (such as a single corner feed) can be used to feed the coupling elements. Left hand circular polarization can also be obtained. Furthermore, a greater number of EMCP pairs can be used in each subarray with the phase difference between each being adjusted accordingly. That is, it is desirable that there be a substantially uniform phase difference of 360°/N, where N is the number of patch pairs; a patch pair P has a feed location orientation and a phase shift relative to the first patch pair of: (P-1)*(360°/N).

As previously mentioned, an antenna array with sequentially rotated feed means and corresponding phase shifting provides good quality circular polarization in the present invention. Additionally, two or more such arrays may be used to produce a low axial ratio over a wide bandwidth. The present invention may further employ an array of two or more such arrays which are sequentially rotated relative to each other with corresponding phase shifting to yield an even lower axial ratio. For example, within each of coupling subarrays 52 and 54 of the described embodiment, the rotation of each element is offset by appropriate phase shifting between elements to produce high-purity, right-hand circularly polarized radiation. Further, within antenna 30, the physical rotation of each EMCP subarray is offset by appropriate phase shifting between the two subarrays by 180°, thereby producing a normalizing effect which reduces reflective effects of impedance mismatches in the interconnect networks and to produce right-hand circularly polarized radiation of particularly high purity.

It has been found that the total surface area of the antenna 30 can be relatively small, from about 2 to about 6 square wavelengths. Space restrictions on a satellite, grating lobe considerations, desired gain and scan volume, mutual coupling and the complexity of the layout of the interconnect networks all influence final size determinations. If the size of the antenna 30 is increased beyond about 6 square wavelengths and the number of elements used remains the same, the larger element spacing results in reduced efficiency and increased grating lobes. While the number of the elements can be increased, the complexity of the interconnect networks would also be increased, thereby consuming additional space.

If the size of antenna 30 is smaller than about 2 square wavelengths and the number of elements is not decreased, there may not be enough space for both patches and interconnect networks and the increased density of elements tends to cause coupling between adjacent elements and between elements and the interconnect networks, thereby degrading the performance of antenna 30. If the number of elements is decreased to reduce adverse coupling, there may be too few elements to produce an acceptable beam (or to satisfactorily receive a beam).

With the present invention, it has been found, therefore, that satisfactory performance with a substantially uniform radiation (or reception) pattern can be achieved with antenna 30 having an area of from about 2 about 6 square wavelengths. A size of about 4½ square wavelengths, with two subarrays 40 and 42 of four patch antenna elements each and two corresponding coupling subarrays 52 and 54 has been found to provide a satisfactory balance among the noted design factors (i.e., grating lobes, gain, scan volume, interconnect network complexity and mutual coupling). Additionally, the interconnect networks can be designed to substantially reduce coupling effects without significant crossovers in such an arrangement.

It has also been found that when the number of elements in antenna subarrays 40 and 42, and coupling subarrays 52 and 54 is a power of two, the interconnect network is less complicated (such as requiring only two-way junctions in order to obtain appropriate power splitting and phase shifting), making it easier to design and produce than if the number of elements is other than a power of two. When the total number of elements in antenna 30 (as opposed to each subarray thereof) is an even power of two (such as $2^4=16$), a "square lattice" arrangement (in which elements are located at each intersection of the rows and columns) can be used to obtain a square layout. When the total number of elements is an odd power of two (such as $2^3=8$), a "triangular lattice" arrangement (in which elements are located at alternating row and column intersections) will enable a square layout to be obtained, as illustrated in FIG. 3. It can be appreciated that, when two subarrays are employed, as they are in the embodiment illustrated in FIG. 3, the shape of the array will be a square if the number of elements in each subarray is an even power of two (such as $2^2=4$) so that the total number of elements in the antenna is an odd power of two such as $2^3=8$).

The described embodiment of the present invention which is square and has two subarrays 40 and 42, and wherein each subarray has four elements arranged in a triangular lattice, represents satisfactory balance of performance, production and design factors.

Referring to FIG. 3, the patch pairs of the two subarrays 40 and 42 are arranged in a matrix having four horizontal rows (row 1 being the top row) and four vertical columns (column 1 being the left most column). In the triangular lattice shown, elements in each row are separated by a column and elements in each column are separated by a row. Thus, in row 1, EMCP pairs GG' and FF' are positioned in columns 1 and 3, respectively; in row 2, EMCP pairs HH' and EE' are positioned in columns 2 and 4, respectively; in row 3, EMCP pairs II' and LL' are positioned in Columns 1 and 3, respectively, and in row 4, EMCP pairs JJ' and KK' are positioned in columns 2 and 4, respectively. This preferred arrangement utilizes fewer EMCP pairs to provide substantially uniform radiation patterns with reduced grating lobes that would be possible with other arrangements, such as two-by-four matrix. A further resulting benefit is that the useful scan volume of an antenna system having several arrays such as antenna 30 is about ±10°-13° which enables better access to low altitude (relative to the horizon) satellites than is possible with a scan volume of about ±9° (which is the required minimum for geosynchronous satellites).

Although other arrangements of the interconnect networks for coupling subarrays 52 and 54 are possible, the arrangement of the described embodiment is advantageous because it conserves space and does not require crossovers. In addition, more than two subarrays can be coupled in sequential rotation to provide even higher purity circular polarization. Alternatively, coupling subarrays 52 and 54 (and any additional subarrays in antenna 30) could be coupled to the signal transmission means in phase with each other using phase transmission line means having the same lengths.

Figure 4:
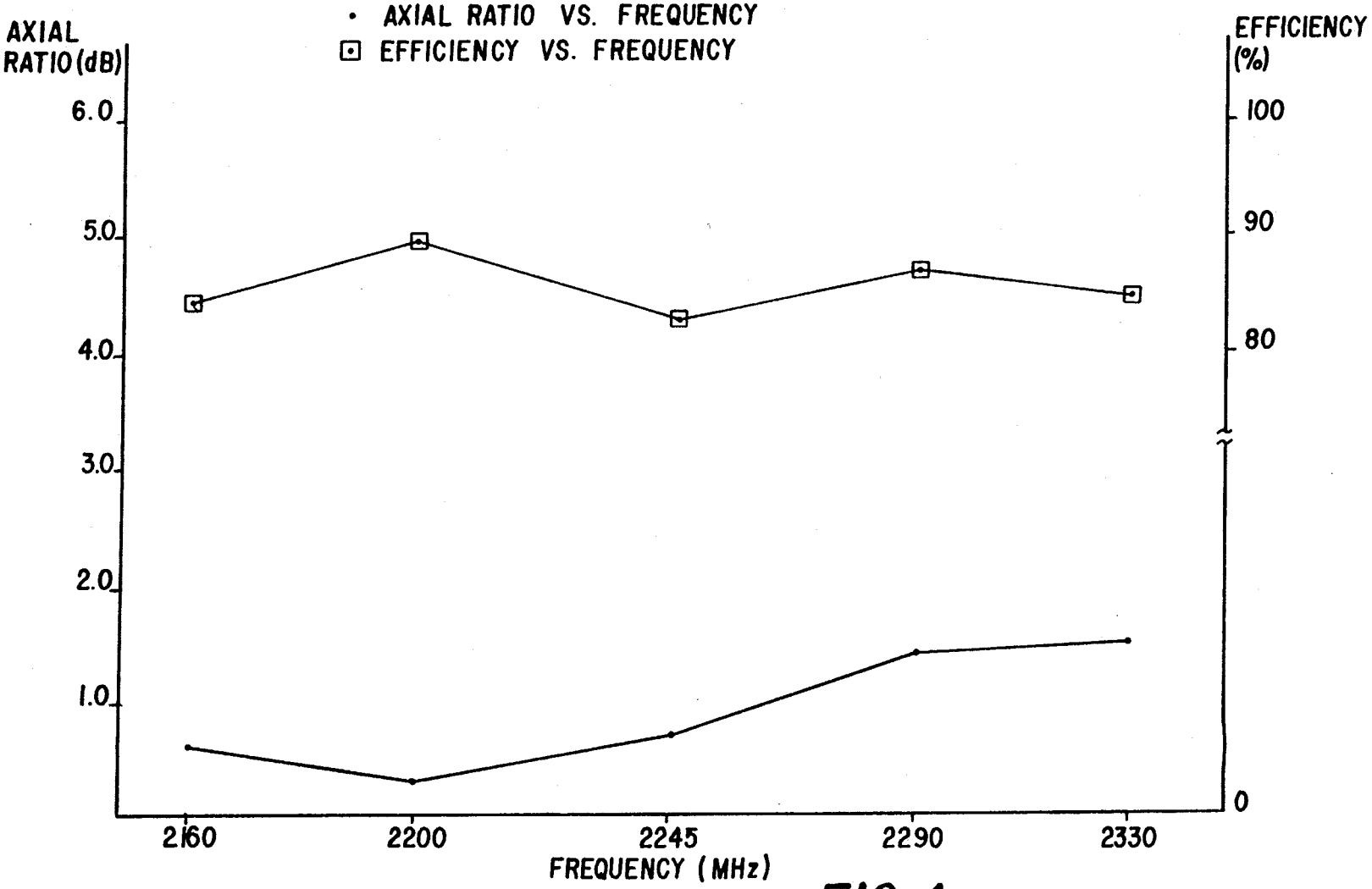
FIG. 4 graphically illustrates the axial ratio and efficiency of the embodiment illustrated in FIGS. 2 and 3 of the invention as functions of operating frequency.

FIG. 4 graphically illustrates the high quality of circular polarization of the described antenna 30 and its high efficiency. The axial ratio (in dB) is plotted against operating frequency in (MHz). The plot confirms that a very low axial ratio of 1.5 or less can be maintained over a bandwidth of about 7.6%. The efficiency (in percent) is also plotted against frequency. The plot confirms that high efficiency of the antenna 30 of at least about 83% is maintained over the same bandwidth. By comparison, a typical prior art antenna without sequential rotation, may have an efficiency of about 55%; and a typical prior art antenna employing conventional sequential rotation may have an efficiency of about 60%.

Antenna 30 can be packaged with additional similar antenna arrays on a satellite and, with the use of phase shifters coupled to each array, a multiple scanning beam phased array antenna system can be provided. In one embodiment, twelve such antenna arrays are packaged to provide a complete antenna system. Each antenna array has two subarrays; each subarray has four EMCP pairs.

Electrostatic discharge protection can be provided without affecting antenna performance by grounding each microstrip patch antenna element with a Z-wire at the electrical center of the element. If additional stiffness is desirable, an additional layer(s) of spacing material and retaining substrate(s) could be added. For example, in relation to the embodiment of FIGS. 2 and 3, another layer of honeycomb material with an additional retaining substrate layer could be disposed below ground plane 38.

Although the present invention has been described in detail, it should be understood that various changes, substitutions and alterations can be made herein without departing from the spirit and scope of the invention as defined by the appended claims. For example, although the embodiments detailed herein employ electromagnetically coupled patch pairs, the present invention could also be constructed with arrays having directly fed antenna patches.

What is claimed is:

1. A broadband, circular polarization antenna array, comprising:

ground means;

a first substrate positioned over said ground means;

at least a first coupling array having a preselected number of microstrip patch elements disposed in a predetermined orientation on a first surface of said first substrate, said microstrip patch elements of said at least first coupling array having feed points in predetermined positions thereon;

a second substrate positioned over and substantially parallel to said first substrate;

at least a first antenna array having said preselected number of microstrip patch elements disposed on a first surface of said second substrate such that each of said microstrip patch elements of said at least first antenna array is positioned above a selected one of said microstrip patch elements of said at least first coupling subarray for electromagnetic coupling therebetween; and at least a first interconnect network comprising a first plurality of phase transmission line means disposed on said first surface of said first substrate to connect said feed points of said microstrip patch elements of said at least first coupling array with a signal transmission means, said phase transmission line means having predetermined lengths for phase shifting signals conducted thereby, whereby said predetermined orientation of said microstrip patch elements, said predetermined positions of said feed points, and said predetermined lengths of said phase transmission line means are selected wherein said microstrip patch elements of said at least first coupling array are in a first sequential rotation relationship and said at least first antenna array is capable of transmitting/receiving circularly polarized signals.

2. The antenna of claim 1 wherein said preselected number is four and said at least first coupling array includes first, second, third and fourth microstrip patch elements.

3. The antenna of claim 2 wherein said plurality of phase transmission line means of said at least first interconnect network comprises:

a first phase transmission line means having a first length and coupled between said first microstrip patch element and said signal transmission means;

a second phase transmission line means having a second length and coupled between said second microstrip patch element and said signal transmission means for providing a phase shift of about 90° relative to said first microstrip patch element;

a third phase transmission line means having a third length and coupled between said third microstrip patch element and said signal transmission means for providing a phase shift of about 180° relative to said first microstrip patch element; and a fourth phase transmission line means having a fourth length and coupled between said fourth microstrip patch element and said signal transmission means for providing a phase shift of about 270° relative to said first microstrip patch element.

4. The antenna of claim 2 wherein said microstrip patch elements of said at least first coupling array are fed so as to excite two orthogonal modes of said microstrip patch elements.

5. The antenna of claim 4 wherein:

each of said microstrip patch elements of said at least first coupling array comprises a square microstrip patch having first, second, third and fourth sides; and said first sequential rotation relationship comprises:

said first microstrip patch element being fed at said first and second sides;

said second microstrip patch element being fed at said second and said third sides;

said third microstrip patch element being fed at said third and said fourth sides; and said fourth microstrip patch element being fed at said fourth and said first sides.

6. The antenna of claim 1 and further comprising:

a second coupling array having said preselected number of microstrip patch elements disposed in a predetermined orientation on said first surface of said first substrate, said microstrip patch elements of said second coupling array having feed points in predetermined positions thereon; and a second antenna array having said preselected number o microstrip patch elements disposed on said first surface of said second substrate such that each of said microstrip patch elements of said second antenna array is positioned above a selected one of said microstrip patch elements of said second coupling array for electromagnetic coupling therebetween; and a second interconnect network comprising a second plurality of phase transmission line means disposed on said first surface of said first substrate, to connect said feed points of said microstrip patch elements of said second coupling array with said signal transmission means, said phase transmission line means of said second interconnect network having predetermined lengths for phase shifting signals conducted thereby, whereby said predetermined orientation of said microstrip patch elements of said second coupling array, said predetermined positions of said feed points, and said predetermined lengths of said phase transmission line means of said second interconnect network are selected wherein said microstrip patch elements of said second coupling array are in said first sequential rotation relationship and said second antenna array is capable of transmitting/receiving circularly polarized signals.

7. The antenna of claim 6 wherein:

said preselected number is four;

said at least first coupling array includes first, second, third and fourth microstrip patch elements; and said second coupling array includes fifth, sixth, seventh and eighth microstrip patch elements.

8. The antenna of claim 7 wherein:

said first plurality of phase transmission line means of said at least first interconnect network comprises:

a first phase transmission line means having a first length and coupled between said first microstrip patch element and said signal transmission means;

a second phase transmission line means having a second length and coupled between said second microstrip patch element and said signal transmission means for providing a phase shift of about 90° relative to said first microstrip patch element;

a third phase transmission line means having a third length and coupled between said third microstrip patch element and said signal transmission means for providing a phase shift of about 180° relative to said first microstrip patch element;

a fourth phase transmission line means having a fourth length and coupled between said fourth microstrip patch element and said signal transmission means for providing a phase shift of about 270° relative to said first microstrip patch element; and said second plurality of phase transmission line means of said second interconnect network comprises:

a fifth phase transmission line means having a fifth length and coupled between said fifth microstrip patch element and said signal transmission means;

a sixth phase transmission line means having a sixth length and coupled between said sixth microstrip patch element and said signal transmission means for providing a phase shift of about 90° relative to said fifth microstrip patch element;

a seventh phase transmission line means having a seventh length and coupled between said seventh microstrip patch element and said signal transmission means for providing a phase shift of about 180° relative to said fifth microstrip patch element; and an eighth phase transmission line means having an eighth length and coupled between said eighth microstrip patch element and said signal transmission means for providing a phase shift of about 270° relative to said fifth microstrip patch element.

9. The antenna of claim 7 wherein said first and second coupling arrays are arrange din a triangular lattice having first, second, third and fourth rows nd first, second, third and fourth columns, wherein:

said first microstrip patch element is in said fourth column of said second row;

said second microstrip patch element is in said third column of said first row;

said third microstrip patch element is in said first column of said second row;

said fourth microstrip patch element is in said second column of said second row;

said fifth microstrip patch element is in said first column of said third row;

said sixth microstrip patch element is in said second column of said fourth row;

said seventh microstrip patch element is in said fourth column of said fourth row; and said eighth microstrip patch element is in said third column of said third row.

10. The antenna of claim 6 wherein said second plurality of phase transmission line means of said second interconnect network comprise at least a ninth phase transmission line means having a preselected length for phase shifting signals conducted thereby, whereby said predetermined orientation of said microstrip patch elements of said first and second coupling arrays, said predetermined positions of said feed points of said microstrip patch elements of said first and second coupling elements, and said predetermined length of said ninth phase transmission line are selected wherein said at least first coupling array and said second coupling array are in a second sequential rotation relationship.

11. The antenna of claim 6 wherein each of said microstrip patch elements of said first and second coupling arrays are fed so as to excite two orthogonal modes of said microstrip patch elements.

12. The antenna of claim 11 wherein:

each of said microstrip patch elements of said first and second coupling arrays comprises a square microstrip patch having first, second, third and fourth sides; and said sequential rotation relationship comprises:

said first and said seventh microstrip patch elements being fed at said first and said second sides;

said second and said eighth microstrip patch elements being fed at said second and said third sides;

said third and said fifth microstrip patch elements being fed at said third and said fourth sides; and said fourth and said sixth microstrip patch elements being fed at said fourth and said first sides.

13. The antenna of claim 1 and further including:

first spacing means positioned between said first and second substrates;

second spacing means positioned below said first substrate; and a third substrate positioned below and substantially parallel to said first substrate, said ground means being disposed on a surface of said third substrate.

14. The antenna of claim 13 wherein said first and second spacing means is characterized by having a dielectric constant from about 1 to about 1.5.

15. The antenna of claim 13 wherein said first and second spacing means comprises a rigid, low dielectric honeycomb material for providing substantially uniform spacing between said first and second substrates and between said first and third substrates.

16. A broadband, circular polarization antenna array, comprising:

ground means;

a first substrate positioned over said ground means;

first spacing means positioned over said first substrate;

a second substrate positioned above and substantially parallel to said first spacing means;

a first subarray having a preselected number of electromagnetically coupled patch pairs of microstrip patch coupling elements and microstrip patch antenna elements, said microstrip patch coupling elements being disposed in a predetermined orientation on a first surface of said first substrate and having feed points in predetermined positions thereon, said microstrip patch antenna elements being disposed on a first surface of said second substrate;

a first interconnect network comprising a first plurality of phase transmission line means disposed on said first surface of said first substrate to connect said feed points of said microstrip patch coupling elements of said first subarray with a signal transmission means, said phase transmission line means of said first interconnect network having predetermined lengths for phase shifting signals conducted thereby, whereby said predetermined orientation of said microstrip patch elements of said first coupling array, said predetermined positions of said feed points, and said predetermined lengths of said phase transmission line means of said first interconnect network are selected wherein said microstrip patch coupling elements of said at least first subarray are in a first sequential rotation relationship and said first subarray is capable of transmitting/receiving circularly polarized signals;

at least a second subarray having said preselected number of electromagnetically coupled patch pairs of microstrip patch coupling elements and microstrip patch antenna elements proximate to said first subarray, said microstrip patch coupling elements of said at least second subarray being disposed in a predetermined orientation on said first surface of said first substrate and having feed points in predetermined positions and said microstrip patch antenna elements of said at least second subarray being disposed on said first surface of said second substrate;

at least a second interconnect network comprising a second plurality of phase transmission line means disposed on said first surface of said first substrate to connect said feed points of said coupling elements of said at least second subarray with said signal transmission means, said phase transmission line means of said at least second interconnect network having predetermined lengths for phase shifting signals conducted thereby, whereby said predetermined orientation of said microstrip patch elements of said second coupling array, said predetermined positions of said feed points, and said predetermined lengths of said phase transmission line means of said second interconnect network are selected wherein said microstrip patch coupling elements of said at least second subarray are in said first sequential rotation relationship and said second subarray is capable of transmitting/receiving circularly polarized signals.

17. The antenna array of claim 16 wherein said second plurality of phase transmission line means or said at least second interconnect network comprises at least one phase transmission line means having a preselected length for phase shifting signals conducted thereby, whereby said predetermined orientation of said microstrip patch elements of said first and second coupling arrays, said predetermined positions of said feed points of said microstrip patch elements of said first and second coupling elements, and said predetermined length of said ninth phase transmission line are selected wherein said first subarray and said at least second subarray are in a second sequential rotation relationship/

18. The antenna array of claim 16 wherein each of said microstrip patch coupling elements of said first and second subarrays are dual fed in phase quadrature.

19. The antenna array of claim 16 wherein:

said preselected number is four;

said first subarray includes first, second, third and fourth microstrip patch coupling elements; and said second subarray includes fifth, sixth, seventh and eighth microstrip patch coupling elements.

20. The antenna array of claim 19 wherein:

said first plurality of phase transmission line means of said first interconnect network comprises:

a first phase transmission line means having a first length and coupled between said first microstrip patch element and said signal transmission means;

a second phase transmission line means having a second length and coupled between said second microstrip patch element and said signal transmission means for providing a phase shift or about 90° relative to said first microstrip patch element;

a third phase transmission line means having a third length and coupled between said third microstrip patch element and said signal transmission means for providing a phase shift of about 180° relative to said first microstrip patch element;

a fourth phase transmission line means having a fourth length and coupled between said fourth microstrip patch element and said signal transmission means for providing a phase shift of about 270° relative to said first microstrip patch element; and said second plurality of phase transmission line means of said at least second interconnect network comprises:

a fifth phase transmission line means having a fifth length and coupled between said fifth microstrip patch element and said signal transmission means;

a sixth phase transmission line means having a sixth length and coupled between said sixth microstrip patch element and said signal transmission means for providing a phase shift of about 90° relative to said fifth microstrip patch element;

a seventh phase transmission line means having a seventh length and coupled between said seventh microstrip patch element and said signal transmission means for providing a phase shift of about 180° relative to said fifth microstrip patch element; and an eighth phase transmission line means having a eighth length and coupled between said eighth microstrip patch element and said signal transmission means for providing a phase shift of about 270° relative to said fifth microstrip patch element;

21. The antenna array of claim 19 wherein said first and second subarrays are arranged in a triangular lattice having first, second, third and fourth rows and first, second, third and fourth columns, wherein:

said first microstrip patch coupling element is in said fourth column of said second row;

said second microstrip patch coupling element is in said third column of said first row;

said third microstrip patch coupling element is in said first column of said first row;

said fourth microstrip patch coupling element is in said second column of said second row;

said fifth microstrip patch coupling element is in said first column of said third row;

said sixth microstrip patch coupling element is in said second column of said fourth row;

said seventh microstrip patch coupling element is in said fourth column of said fourth row; and said eighth microstrip patch coupling element is in said third column of said third row.

22. The antenna array of claim 16 and further including:

second spacing means positioned below said first substrate; and a third substrate positioned below and substantially parallel to said second spacing means, said ground means being disposed on a surface of said third substrate.

23. The antenna array of claim 16 wherein said first spacing means is characterized by having a dielectric constant from about 1 to about 1.5.

24. The antenna array of claim 16 wherein said first spacing means comprises a rigid, low dielectric honeycomb material for providing substantially uniform spacing between said first and second substrates.

25. A broadband, circular polarization antenna array, comprising:

ground means;

a first substrate positioned over said ground means;

first spacing means positioned over said first substrate;

a second substrate positioned above and substantially parallel to said first spacing means;

a first subarray having a preselected number of electromagnetically coupled patch pairs of microstrip patch coupling elements and microstrip patch antenna elements, said microstrip patch coupling elements being disposed in a predetermined orientation on a first surface of said first substrate and having feed points in predetermined positions thereon, said microstrip patch antenna elements being disposed on a first surface of said second substrate;

a first interconnect network comprising a first plurality of phase transmission line means disposed on said first surface of said first substrate to connect said feed points said microstrip patch coupling elements of said first subarray with a signal transmission means, said phase transmission line means of said first interconnect network having predetermined lengths for phase shifting signals conducted thereby, whereby said predetermined orientation of said microstrip patch elements of said first coupling array, said predetermined positions of said feed points, and said predetermined lengths of said phase transmission line means of said first interconnect network are selected wherein said microstrip patch coupling elements of said at least first subarray are in a first sequential rotation relationship and said first subarray is capable of transmitting/receiving circularly polarized signals;

at least a second subarray having said preselected number of electromagnetically coupled patch pairs of microstrip patch coupling elements and microstrip patch antenna elements proximate to said first subarray, said microstrip patch coupling elements of said at least second subarray being disposed in a predetermined orientation on said first surface of said first substrate and having feed points in predetermined positions thereon, and said microstrip patch antenna elements of said at least second subarray being disposed on said first surface of said second substrate;

at least a second interconnect network comprising a second plurality of phase transmission line means disposed on said first surface of said first substrate to connect said feed points of said coupling elements of said at least second subarray with said signal transmission means, said phase transmission line means of said at least second interconnect network having predetermined lengths for phase shifting signals conducted thereby, whereby said predetermined orientation of said microstrip patch elements of said second coupling array, said predetermined positions of said feed points, and said predetermined lengths of said phase transmission line means of said second interconnect network are selected wherein said microstrip patch coupling elements of said at least second subarray are in said first sequential rotation relationship, said second plurality of phase transmission line means of said at least second interconnect mans comprising a phase transmission line having a preselected length for phase shifting signals conducted thereby, and whereby said predetermined orientation of said microstrip patch elements of said first and second coupling arrays, said predetermined positions of said feed points of said microstrip patch elements of said first and second coupling elements, and said predetermined length of said ninth phase transmission line are selected wherein said first subarray and said at least second subarray are in a second sequential rotation relationship and said second subarray is capable of transmitting/receiving circularly polarized signals;

second spacing means positioned below said first substrate; and a third substrate positioned below and substantially parallel to said second spacing means, said ground means being disposed on a surface of said third substrate.

26. The antenna of claim 25 wherein:

said preselected number is four;

said first subarray includes first, second, third and fourth microstrip patch coupling elements;

said second subarray includes fifth, sixth, seventh and eighth microstrip patch coupling elements;

said first plurality of phase transmission line means of said first interconnect network comprises:

a first phase transmission line means having a first length and coupled between said first microstrip patch element and said signal transmission means;

a second phase transmission line means having a second length and coupled between said second microstrip patch element and said signal transmission means for providing a phase shift of about 90° relative to said first microstrip patch element;

a third phase transmission line means having a third length and coupled between said third microstrip patch element and said signal transmission means for providing a phase shift of about 180° relative to said first microstrip patch element;

a fourth phase transmission line means having a fourth length and coupled between said fourth microstrip patch element and said signal transmission means for providing a phase shift of about 270° relative to said first microstrip patch element; and said second plurality of phase transmission line means of said at least second interconnect network comprises:

a fifth phase transmission line means having a fifth length and coupled between said fifth microstrip patch element and said signal transmission means;

a sixth phase transmission line means having a sixth length and coupled between said sixth microstrip patch element and said signal transmission means for providing a phase shift of about 90° relative to said fifth microstrip patch element;

a seventh phase transmission line means having a seventh length and coupled between said seventh microstrip patch element and said signal transmission means for providing a phase shift of about 180° relative to said fifth microstrip patch element; and an eighth phase transmission line means having a eighth length and coupled between said eighth microstrip patch element and said signal transmission means for providing a phase shift of about 270° relative to said fifth microstrip patch element;

27. The antenna array of claim 25 wherein said first and second spacing means are characterized by having a dielectric constant form about 1 to about 1.5.

28. The antenna array of claim 25 wherein:

said first spacing means comprises a rigid, low dielectric honeycomb material for providing substantially uniform spacing between said first and second substrates; and said second spacing means comprises said rigid, low dielectric honeycomb material for providing substantially uniform spacing between said first and third substrates.

* * * * *